US005573372A

United States Patent [19]

Badger

[11] Patent Number: 5,573,372

[45] Date of Patent: Nov. 12, 1996

[54] EMERGENCY ENABLEMENT DEVICE FOR A BOAT PROPELLER

[76] Inventor: Michael H. Badger, 8100 N. Mopac, Number 279, Austin, Tex. 78759

[21] Appl. No.: 253,962

[22] Filed: Jun. 3, 1994

[51] Int. Cl.[6] ..... B63H 1/20; B63H 20/26

[52] U.S. Cl. ..... 416/93A; 416/146 R; 416/244 B

[58] Field of Search ..... 416/2, 93 A, 134, 416/170 R, 146, 244 B, 245 A

[56] References Cited

U.S. PATENT DOCUMENTS

| | | | |
|---|---|---|---|
| 3,589,833 | 6/1971 | Lancioni . | |
| 3,759,076 | 9/1973 | Reese | 416/93 A |
| 3,827,259 | 8/1974 | Brucker . | |
| 3,857,257 | 12/1974 | Steiner et al. . | |
| 3,876,331 | 4/1975 | DenHerder et al. . | |
| 4,097,191 | 6/1978 | Genuardi . | |
| 4,218,896 | 8/1980 | van der Lely . | |
| 4,317,655 | 8/1982 | Schiek . | |
| 5,071,376 | 12/1991 | Walker . | |

*Primary Examiner*—James Larson

[57] ABSTRACT

Disclosed is an apparatus for emergency enablement of a boat propeller. The apparatus includes a central mounting plate having an aperture for engagement with one end of the propeller shaft to which the propeller is attached. A drive plate is affixed to the central mounting plate for drive engagement with the propeller. Upon striking an underwater object, bolts connecting the drive and mounting plate will shear to protect the boat's engine from damage. One or more cantilevered members, the proximal ends of which are fixed around the periphery of the central mounting plate, extend from the mounting plate for disposal within longitudinal spaces of the boat propeller.

10 Claims, 4 Drawing Sheets

EMERGENCY ENABLEMENT DEVICE FOR A BOAT PROPELLER

BACKGROUND OF THE INVENTION

1. Field of the Invention

The present invention relates to boat propellers. In another aspect, the present invention relates to boat propellers of the type having a tubular body from which propeller blades project and having an inwardly spaced hub assembly by which the propeller is attached to a propeller shaft. In still another aspect, the present invention pertains to an apparatus for the temporary or emergency enablement of such a boat propeller which has been disabled by shearing or otherwise separating of a portion of the hub assembly thereof so that the propeller body no longer rotates in response to rotation of the propeller shaft.

2. Description of the Related Art

There are many boats which are powered by outboard or inboard-outboard motors. Motors of the type in which the exhaust exists through the propeller utilize a boat propeller of the type which has a tubular body, from which propeller blades project, and an inwardly spaced hub assembly for attachment to a propeller shaft. The hub assembly typically includes an outer tubular member concentrically supported within the tubular propeller body by a plurality of radially or spirally extending ribs between which are a plurality of longitudinal spaces. The longitudinal spaces serve as exhaust ports for the motor or engine by which the propeller shaft is driven. An inner tubular sleeve of the hub assembly provides a central bore through which the propeller shaft extends for engagement by a nut or other fastener to attach the propeller to the propeller shaft.

The hub assembly may also include an intermediate tubular sleeve of resilient material concentrically fixed between the inner and outer sleeves of the hub assembly. This resilient intermediate sleeve absorbs shock and transmits power from the propeller shaft to the propeller body. However, the intermediate sleeve is assembled and is of a material such that upon application of abnormal torsional forces the intermediate sleeve is sheared or separated so that the propeller body no longer rotates in response to rotation of the shaft. Thus, the intermediate sleeve acts as a shock absorber and in severe cases shears or separates from the inner and/or outer sleeves to prevent further damage to the engine, propeller shaft or other components of the boat.

Typically, abnormal shock or torsional forces are transmitted to a propeller upon contact with a submerged obstacle, e.g., log, stump, etc. or by fouling of the propeller with seaweed, rope, etc. In the event of such an occurrence and shearing or separation of the intermediate sleeve due thereto, the propeller may be disenabled and incapable of moving the boat through the water. Such a situation could be exasperating and dangerous. If a spare propeller is not available or if the boat cannot be towed by another boat, the boat and its occupants may lie powerless for hours or days with ominous consequences.

Most boat owners and operators do not prepare for propeller disablement, thinking, as many, that this would not happen to them. Others prepare for such an event by having a spare propeller on board the boat. However, to install a spare propeller, it is necessary to remove the disabled propeller by removing a nut attached to the threaded end of the propeller shaft and pulling the inner sleeve of the propeller hub assembly off of the propeller shaft. Removing the nut is frequently the simplest part of this procedure.

Disengaging the inner sleeve of the hub assembly from the propeller shaft is frequently difficult and sometimes impossible under usual circumstances. The tight fit of these members, corrosion, difficult access, lack of proper tools, etc. are all reasons why such a remedy may fail. Obviously, better and easier methods of emergency enablement of disabled boat propellers are needed and hoped for.

U.S. Pat. No. 5,071,376, issued Dec. 10, 1991 to Walker, discloses an apparatus for emergency enablement of a disabled boat propeller which includes a plate member having an aperture for engagement with and attachment to the end of the propeller shaft and further including a plurality of cantilevered members, the proximal ends of which are radially spaced from the plate member aperture. When the apparatus is attached to the end of the propeller shaft, the cantilevered members extend, parallel to the propeller shaft and the axis of the plate member aperture, projecting through longitudinal spaces between the propeller body and the hub assembly for engagement with the ribs connecting these last two members to at least temporarily restore rotational response of the propeller body to rotation of the propeller shaft.

Unfortunately, the disabled boat propeller enablement apparatus of U.S. Pat. No. 5,071,376 lacks any means for preventing damage to the engine, propeller shaft or other components of the boat, in the event that the propeller or the enablement apparatus were to encounter abnormal shock or torsional forces of the type which disabled the boat in the first instance. In such a circumstance, the boat would once again be disabled, with additional damage to the engine, propeller shaft or other components of the boat.

Boat propeller designs vary in the number and size of the exhaust ports. Thus, the disabled boat propeller enablement apparatus of U.S. Pat. No. 5,071,376, with its plurality of cantilevered members for engaging the blades of the disabled propeller, may require different designs to fit in a small three port exhaust as opposed to a large five port exhaust.

SUMMARY OF THE INVENTION

It is one object of the present invention to provide a disabled boat propeller enablement means that is suitable for preventing damage to the engine, propeller shaft or other components of the boat, in the event that the propeller or the enablement apparatus were to encounter abnormal shock or torsional forces of the type which disabled the boat in the first instance.

It is another object of the present invention to provide a disabled boat propeller enablement means that has universal fit for three, four and five exhaust port propeller designs.

These and other objects of the present invention will become apparent to those of skill in the art upon review of this specification.

According to one embodiment of the present invention there is provided an apparatus for temporary or emergency enablement of a boat propeller of the type having a tubular body from which the propeller blades project and an inwardly spaced hub assembly for attachment to a propeller shaft. The hub assembly of most boat propellers would normally include an outer tubular sleeve to which the propeller body is attached, an inner tubular sleeve for engagement with a propeller shaft and an intermediate tubular sleeve of resilient material for absorbing shock and transmitting rotational forces from the propeller shaft to the propeller body. The intermediate sleeve would be shearable or separateable upon application of abnormal torsional forces thereto so that the propeller body no longer rotates in response to rotation of the shaft.

The emergency enabling apparatus will generally include a drive plate having an aperture at the center thereof for receiving and engaging one end of the boat's propeller shaft. The apparatus will also include a central mounting plate having an aperture at the center thereof for receiving said one end of said propeller shaft. The drive plate and the mounting plate are affixed together by an attachment member, such as bolts, in such a manner that said one end of the propeller shaft may be received through the mounting plate aperture and received into and engaged with the drive plate aperture. Extending from the mounting plate are a plurality of cantilevered members the proximal ends of which are fixed at spaced intervals around the periphery of the central mounting plate. The cantilevered members extend perpendicular to the central mounting plate for disposal within the elongated passages between the support members of the propeller upon fixed engagement of the drive plate aperture with the propeller shaft to restore rotational response of said propeller body to rotation of the propeller shaft.

According to another embodiment of the present invention there is provided an emergecy enablement apparatus which includes a central mounting plate having an aperture at the center thereof for engagement with one end of the propeller shaft. The central mounting plate consists essentially of one cantilevered member, the proximal end of which is fixed at the periphery of central mounting plate, and extends perpendicular to said central mounting plate for disposal within one of the elongated passages between the support members of the propeller.

DETAILED DESCRIPTION OF THE INVENTION

Figure 1:
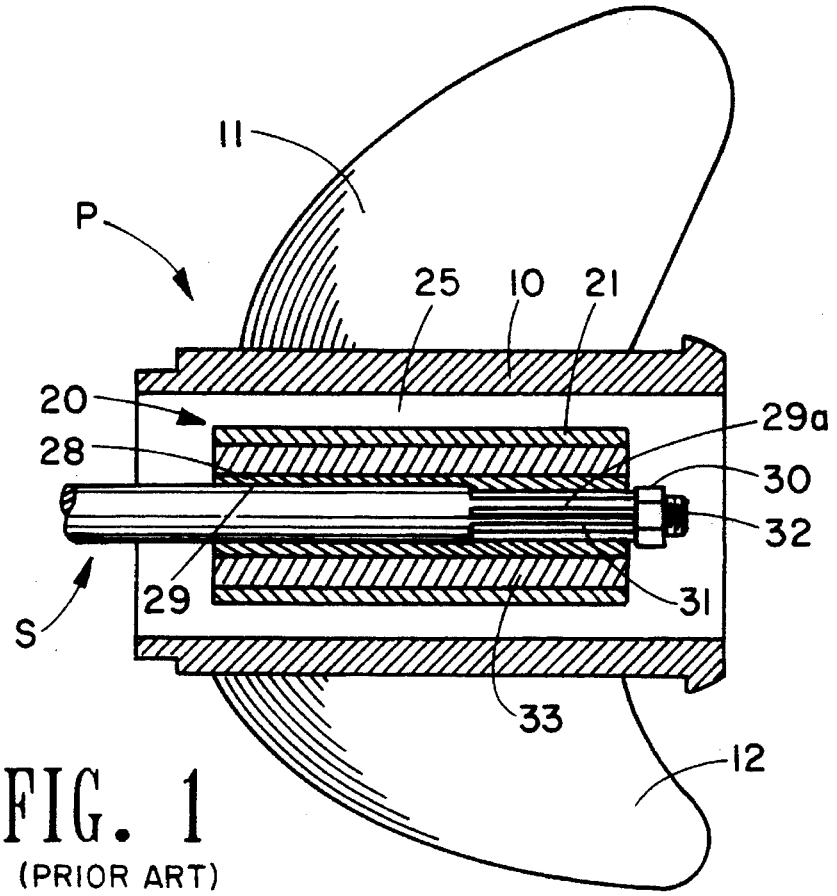
FIG. 1 (PRIOR ART)
FIG. 1 is a longitudinal drawing of a propeller, partially in section, taken along line 1—1 of FIG. 2, connected to the end of a propeller shaft.
Figure 2:
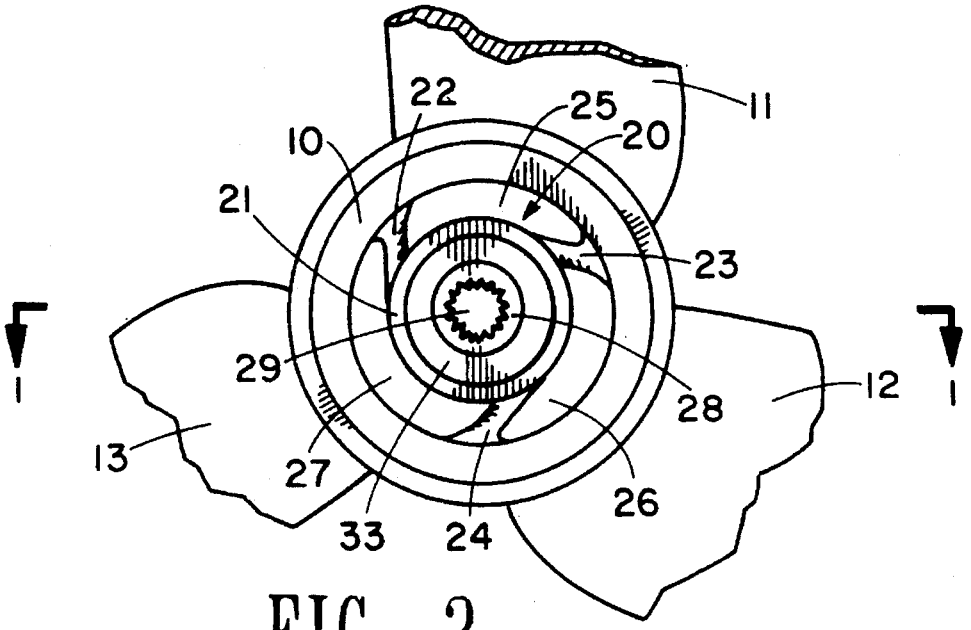
FIG. 2 (PRIOR ART)
FIG. 2 is a partial end view of the propeller of FIG. 1.

Referring first to FIGS. 1 and 2, there is shown a boat propeller P attached to the end of a propeller shaft S. The boat propeller P has a tubular body 10 from which propeller blades 11, 12, 13 project and an inwardly spaced hub assembly 20 for attachment to the propeller shaft S.

The hub assembly 20 comprises an outer tubular member 21 concentrically supported within the tubular body 10 by plurality of radially or spirally extending support members or ribs 22, 23, 24, between which are left a plurality of longitudinally elongated spaces or passages 25, 26 and 27. The purpose of the spaces 25, 26 and 27 is to provide a path for the exhaust of the engine or motor, which drives the propeller shaft S. While the outer tubular sleeve 21 is described as part of the hub assembly 20, it and the ribs 22, 23, 24 by which it is supported within the tubular body 10 may actually be integrally formed therewith by molding or other means of fabrication. These components may be of aluminum, other metals or other suitable materials.

The hub assembly 20 also includes an inner tubular sleeve 28 which has a central bore 29 through which the shaft S extends for engagement by a nut 30 or other fasteners. Typically, the end of the shaft S is splined as at 31 and threaded as at 32 to receive the nut 30. The inner sleeve 28 may also be counterbored and provided with splines 29*a* to match the splines 31 of the propeller shaft S. It should be noted that in FIG. 2, the shaft S has been removed to more fully understand the components of the propeller P.

Interposed between the outer tubular sleeve 21 and the inner tubular sleeve 28 of the hub assembly 20 is an intermediate tubular sleeve 33 of a resilient material such as rubber. The intermediate sleeve 33 is tightly pressed between the outer and inner sleeves 21 and 28 and is actually bonded thereto by adhesives or any other suitable means. Thus, rotation of the propeller shaft S and the inner sleeve 28 of the hub assembly 20 is transmitted through intermediate sleeve 33 to outer sleeve 21 and the propeller body 10. Since the intermediate sleeve 33 is of a resilient material, it absorbs shock which might otherwise be absorbed by the propeller shaft S and its motor upon contact of the propeller blades 11, 12, 13 with underwater obstacles. In addition, upon the application of abnormal torsional forces to the propeller P, from contact with underwater obstacles or fouling of the propeller, the intermediate sleeve 33 and its bond with one or both of the outer and inner sleeve members 21, 28 may be sheared or separated, allowing the propeller shaft S to continue to rotate even though the propeller body 10 and its blades 11, 12 and 13 may be prevented from rotation by the underwater obstacle. This prevents greater damage to the propeller shaft S and the motor by which it is driven. Of course, after shearing or separation of the intermediate sleeve 33, the propeller body 10 and propellers 11, 12 and 13 no longer respond to rotation of the propeller shaft S. The propeller P can then be said to be disabled, requiring repair, replacement or emergency enablement.

Figure 3:
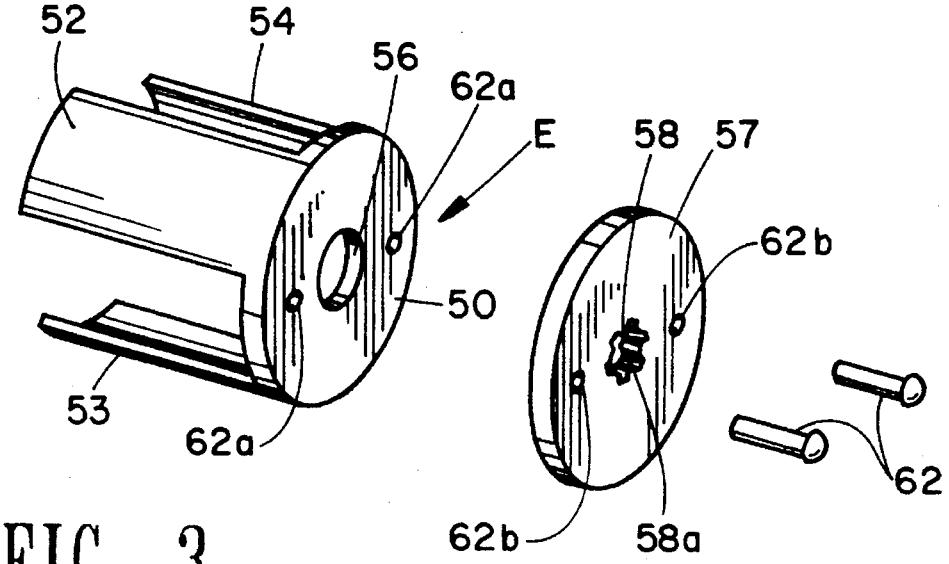
FIG. 3 is a perspective exploded view of an apparatus suitable for emergency enablement of a disabled propeller of the type shown in FIGS. 1 and 2, according to a one embodiment of the invention.
Figure 4:
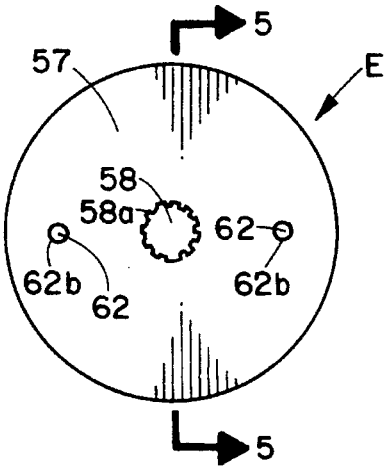
FIG. 4 is an end view of the emergency enablement apparatus of FIG. 3.
Figure 5:
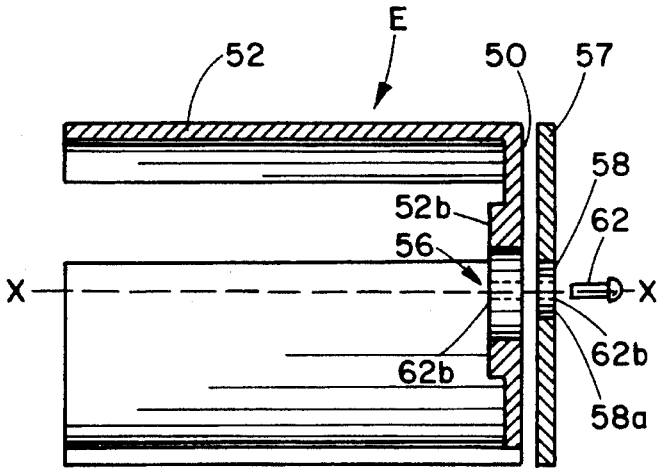
FIG. 5 is a longitudinal exploded view, in section along line 5—5 of FIG. 4, of the emergency enablement apparatus of FIGS. 3 and 4.
Figure 9:
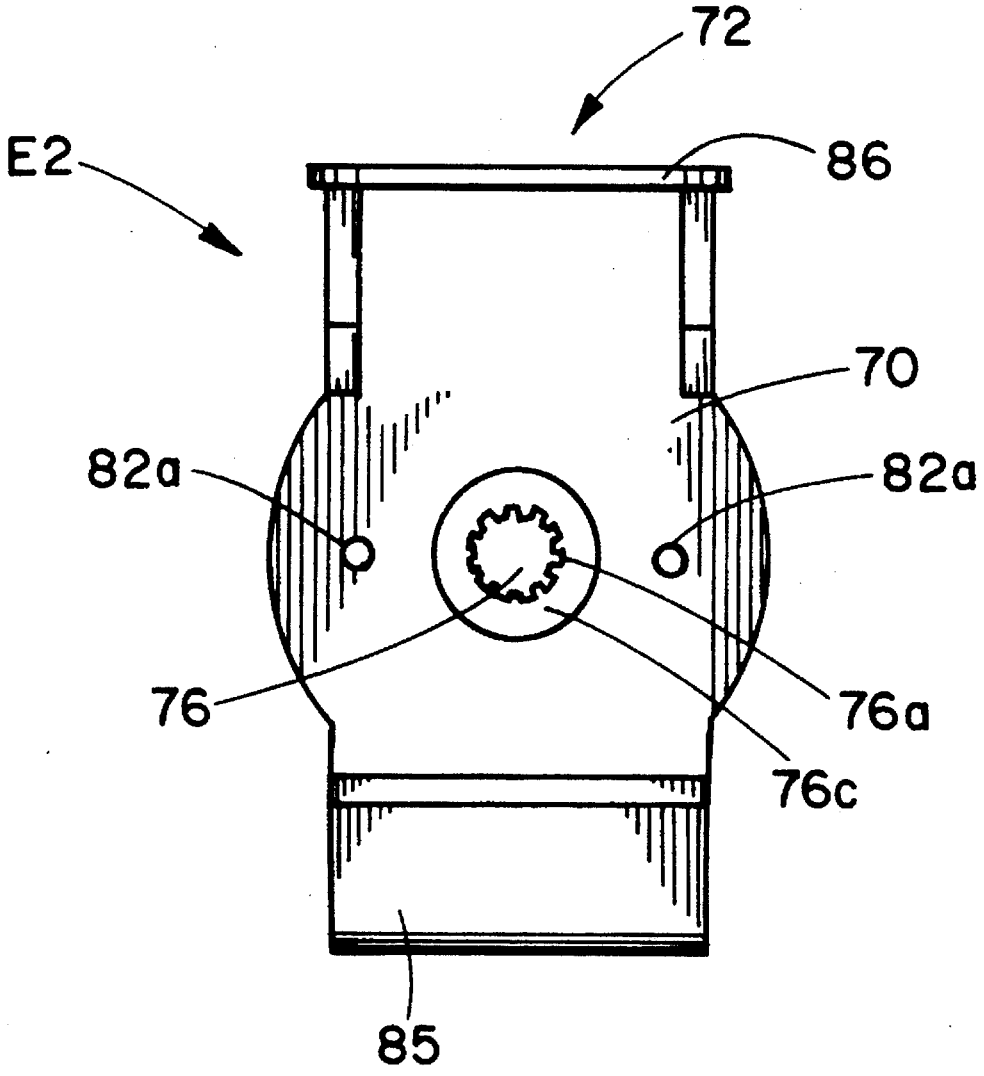
FIG. 9 is an end view of alternative embodiment of emergency apparatus E2, showing optional grooves 76*a* and optional annular shoulder 76*c*.

Referring now to FIGS. 3, 4 and 5, there is shown one embodiment of the emergency enabling apparatus E of the present invention, by which a disabled propeller of the type shown in FIGS. 1 and 2 may be at least temporarily enabled.

FIG. 3 is a perspective exploded view of apparatus E suitable for emergency enablement of a disabled propeller of the type shown in FIGS. 1 and 2, according to a one embodiment of the invention. Of course, it is to be understood that in operation, apparatus E will be assembled. FIG. 4 is an end view of the emergency enablement apparatus of FIG. 3. FIG. 5 is a longitudinal exploded view, in section along line 5—5 of FIG. 4, of the emergency enablement apparatus E of FIGS. 3 and 4

The apparatus E comprises a plate member 50, which in the embodiment shown is circular, although plate member 50 may be any suitable shape. Aperture 56 goes through the center of member 50 and is sized to receive the end of the propeller shaft S of FIG. 1.

A plurality of cantilevered members 52, 53 and 54, the proximal ends of which are radially spaced from the plate central aperture 56, extend parallel to the central axis X—X of the aperture 56. While the present illustrated embodiment is shown with three cantilevered members, it is to be understood that any suitable number of members may be utilized, including one, two, three, four, five or more cantilevered members.

The apparatus E further comprises plate member 57 which is affixed to plate member 50 by one or more attachment/shear means, which are shown in FIG. 3 as rivets 62. Each rivet 62 is positioned in aperture **62*b* of member 57 and aperture 62*a* of member 50 to attach member 50 to member 57**.

Figure 8:
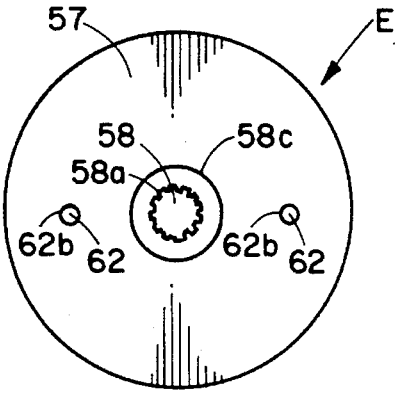
FIG. 8 is an end view of emergency enablement apparatus of FIG. 3 showing optional shoulder member 58*c*.

Aperture 58 is sized for engagement with the end of propeller shaft S of FIG. 1. The aperture 58 may be grooved or splinted as at **58*a* for positive engagement with the splines 31 of propeller shaft S. Additionally, plate member 57 may be reinforced around aperature 58 by an annular shoulder member. This optimal annular shoulder member is shown as member 58*c* in FIG. 8**.

The attachment/shear means 62 are designed to serve two functions.

First, the attachment/shear means 62 must be designed to withstand the normal stresses associated with driving propeller P.

Second, the attachment/shear means 62 must be designed to shear in the event that propeller P or the enablement apparatus were to encounter abnormal shock or torsional forces of the type which disabled the boat in the first instance. Once the attachment/shear means 62 shears, propeller shaft S will continue to rotate even though propeller body 10 and propellers 11, 12 and 13 may be prevented from rotation by the underwater obstacle.

Figure 6:
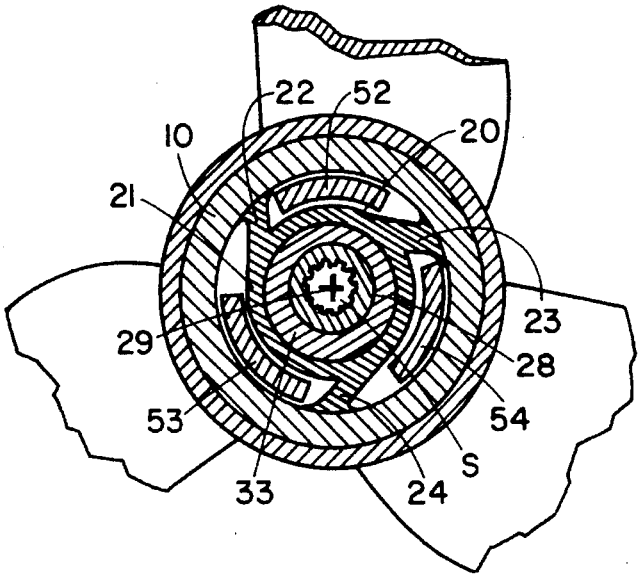
FIG. 6 is a partial cross-sectional view of the propeller of FIGS. 1 and 2 with the emergency enablement apparatus of FIGS. 3–5 attached hereto.

Upon disablement of a propeller, such as the propeller P in FIGS. 1 and 2, due to the shearing or separation of hub assemblies intermediate sleeve 33, nut 30 is removed from propeller shaft S. Next, the distal ends of cantilevered members 52, 53 and 54 are inserted through longitudinal spaces 25, 26 and 27 of propeller P (see FIG. 6), so that propeller shaft S is positioned in aperture 56 and the splines 31 of Shaft S are engaged with the splines of aperture 58. Then nut 30 is reengaged with threaded portion 32 of propeller shaft S, fixing the enabling apparatus E in place so that rotation of shaft S will cause cantilevered members 52, 53 and 54 to engage ribs 22, 23 and 24 at least temporarily restoring rotational response of propeller body 10 and propeller blades 11, 12 and 13 to rotation of propeller shaft S. With enabling apparatus E in place, the boat may be propelled through the water by propeller P to a point where enabling apparatus E and damaged propeller P may be easily removed for repair or replacement.

In the event of striking another underwater obstacle, the attachment/shear means 62 will shear, thus protecting the boat's engine.

Figure 7:
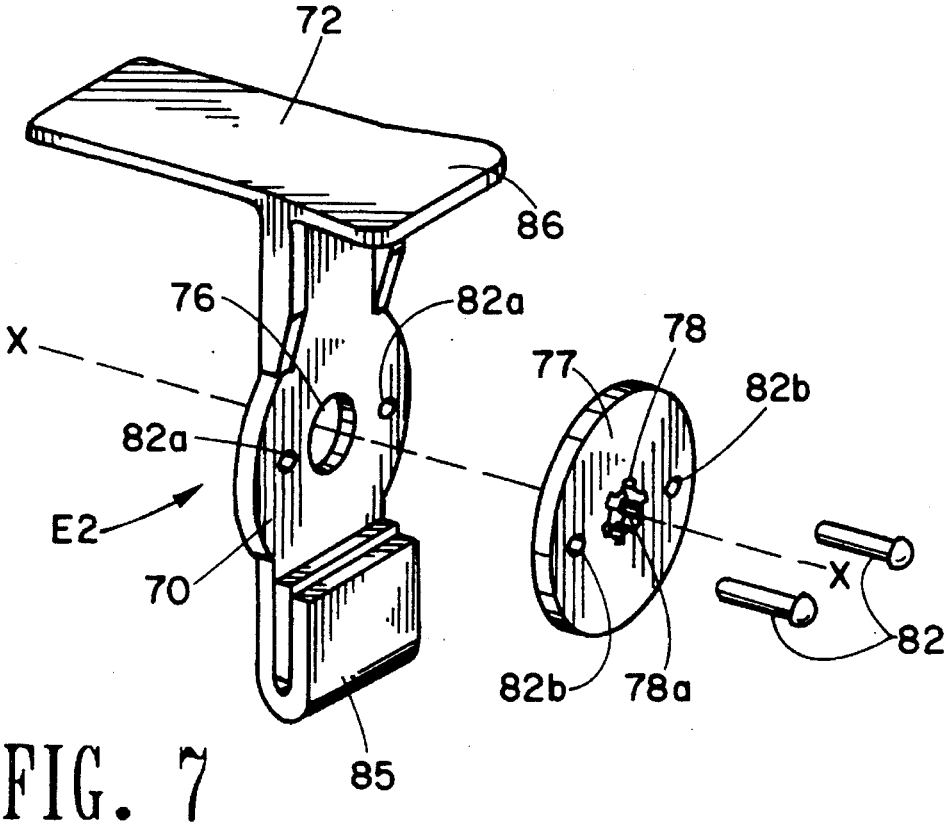
FIG. 7 is an exploded perspecitve view of another embodiment of the emergency enablement apparatus of the present invention.

Referring now to FIG. 7, there is shown another embodiment of the emergency enabling apparatus E2 of the present invention, by which a disabled propeller of the type shown in FIGS. 1 and 2 may be at least temporarily enabled.

The apparatus E2 comprises a plate member 70, which in the embodiment shown is circular, although plate member 70 may be any suitable shape. Aperture 76 goes through the center of member 70 and is sized to receive the end of the propeller shaft S of FIG. 1. A single cantilevered member 72, the proximal end of which is radially spaced from the plate central aperture 76, extends parallel to the central axis X—X of the aperture 76.

The apparatus E2 may optionally comprise plate member 77 which is affixed to plate member 70 by one or more attachment/shear means 82, which are shown in FIG. 7 as rivets 82. Each rivet 82 is positioned in aperture **82*b* of member 77 and aperture 82*a* of member 70 to attach member 70 to member 77**.

As with the attachment/shear means 62 in the above embodiment, the attachment/shear means 82 must be designed to withstand the normal stresses associated with driving propeller P, additionally, must be designed to shear in the event that propeller P were to encounter abnormal shock or torsional forces of the type which disabled the boat in the first instance.

Aperture 78 is sized for engagement with the end of propeller shaft S of FIG. 1. Aperture 78 may be grooved or splined as at **78*a* for positive engagement with the splines 31 of propeller shaft S. Additionally, plate member 77 may be reinforced around aperature 78** by an annular shoulder member.

Apparatus E2 further comprises one or more balancing members 85 and 86 to balance apparatus E2 during its rotational operation.

An important advantage of this single cantilevered member emergency apparatus is that it may be useful for many different types of propeller designs. For example, this one size may be useful for both a small three port exhaust as well as for a large five port exhaust.

It is to be understood that appartus E2 may also be utilized without plate member 77 in which case, aperature 76 must be suitable to engage propeller shaft S. Thus, aperture 76 may be grooved or splined for positive engagement with the splines 31 of propeller shaft S. Additionally, if driven by propeller shaft S, plate member 70 may be reinforced around aperature 76 by an annular shoulder member.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled the art to which this invention pertains.

I claim:

1. An apparatus for emergency or temporary enablement of a disabled boat propeller having a tubular body from which propeller blades project and inwardly spaced hub means for attachment to a propeller shaft, said hub means being concentrically supported within said tubular body by a plurality of radially or spirally emanating support members between which are a plurality of elongated passages, said hub means including a tubular sleeve of resilient material for absorbing shock and transmitting power from said propeller shaft to said tubular body and blades but being shearable or separateable upon application of abnormal torsional forces thereto so that said tubular body will no longer rotate in response to rotation of said shaft, said emergency enabling apparatus comprising:

a drive plate having an aperture at the center thereof for receiving and engaging one end of said propeller shaft;

a central mounting plate having an aperture at the center thereof for receiving said one end of said propeller shaft;

attachment means for attaching together the mounting plate and drive plate in such a manner that said one end of the propeller shaft may be received through the mounting plate aperture and received into and engaged with the drive plate aperture;

a plurality of cantilevered members the proximal ends of which are fixed at spaced intervals around the periphery of said central mounting plate, wherein the plurality of cantilevered members extend perpendicular to the central mounting plate for disposal within the elongated passages between the support members upon fixed engagement of the drive plate aperture with said one end of the propeller shaft to restore operational response of said tubular body to rotation of said propeller shaft after shearing or separation of said tubular sleeve of said resilient material, and wherein the attachment means fails during application of abnormal torsional forces to the propeller of tubular body.

2. The apparatus of claim 1 wherein the mounting plate is circular.

3. The apparatus of claim 1 wherein the drive plate is circular.

4. The apparatus of claim 3 wherein the drive plate is reinforced around the drive plate aperature by an annular shoulder.

5. The apparatus of claim 1 wherein the drive plate aperature is grooved to provide a surface for increased frictional engagement with said one end of said propeller shaft.

6. The apparatus of claim 1 wherein said cantilevered members partially define a cylinder, longitudinal strips of which have been removed therebetween.

7. An apparatus for emergency or temporary enablement of a disabled boat propeller having a tubular body from which propeller blades project and inwardly spaced hub means for attachment to a propeller shaft, said hub means being concentrically supported within said tubular body by a plurality of radially or spirally emanating support members between which are a plurality of elongated passages, said hub means including a tubular sleeve of resilient material for absorbing shock and transmitting power from said propeller shaft to said tubular body and blades but being shearable or separateable upon application of abnormal torsional forces thereto so that said tubular body will no longer rotate in response to rotation of said shaft; said emergency enabling apparatus comprising:

a central mounting plate having an aperture at the center thereof for engagement with one end of said propeller shaft, and consisting essentially of one cantilevered member, the proximal end of which is fixed at the periphery of said central mounting plate, said cantilevered member extending perpendicular to said central mounting plate for disposal within one of the elongated passages between said support members upon fixed engagement of said mounting plate aperture with said one end of propeller shaft to restore rotational response of said tubular body to rotation of said propeller shaft after shearing or separation of said tubular sleeve of said resilient material.

8. The apparatus of claim 7 wherein the mounting plate is circular.

9. The apparatus of claim 13 wherein the mounting plate is reinforced around the aperature by an annular shoulder.

10. The apparatus of claim 7 wherein the mounting plate aperature is grooved to provide a surface for increased frictional engagement with said one end of said propeller shaft.

* * * * *